US007607752B2

(12) United States Patent
Childers et al.

(10) Patent No.: US 7,607,752 B2
(45) Date of Patent: Oct. 27, 2009

(54) MISFIRING PRINT NOZZLE COMPENSATION

(75) Inventors: Winthrop D. Childers, San Diego, CA (US); Ronald A. Askeland, San Diego, CA (US); Guo Li, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 414 days.

(21) Appl. No.: 11/601,312

(22) Filed: Nov. 17, 2006

(65) Prior Publication Data

US 2008/0117249 A1 May 22, 2008

(51) Int. Cl.
*B41J 29/393* (2006.01)

(52) U.S. Cl. ..... 347/19; 347/15

(58) Field of Classification Search ..... 347/12, 347/15, 19, 43; 358/504
See application file for complete search history.

(56) References Cited

U.S. PATENT DOCUMENTS 5,534,895 A 7/1996 Lindenfelser et al.
5,581,284 A * 12/1996 Hermanson ..... 347/43
5,644,344 A 7/1997 Haselby
6,003,980 A 12/1999 Sheinman et al.
6,027,201 A 2/2000 Edge
6,109,721 A 8/2000 Kim
6,161,914 A 12/2000 Haselby
6,213,580 B1 * 4/2001 Segerstrom et al. ..... 347/19
6,241,334 B1 6/2001 Haselby
6,347,857 B1 2/2002 Purcell
6,354,689 B1 * 3/2002 Couwenhoven et al. ..... 347/19
6,457,807 B1 10/2002 Hawkins et al.
6,561,613 B2 5/2003 Cunnagin et al.
6,568,787 B1 5/2003 Girones et al.
RE38,180 E 7/2003 Edge
6,702,426 B2 3/2004 Yashima
6,843,547 B2 1/2005 Adkins et al.
2001/0009429 A1 7/2001 Soto et al.
2003/0067503 A1 4/2003 Cunnagin et al.
2003/0081024 A1 5/2003 Vives et al.
2004/0189731 A1 9/2004 Walmsley et al.
2005/0046658 A1 3/2005 Kojima
2005/0122366 A1 6/2005 Nagamura et al.
2005/0174384 A1 8/2005 Koitabashi et al.
2005/0253879 A1 11/2005 Yamanobe
2006/0132525 A1 6/2006 Walmsley et al.
2006/0139388 A1 6/2006 Silverbrook et al.
2006/0164453 A1 7/2006 Silverbrook et al.

* cited by examiner

*Primary Examiner*—Lamson D Nguyen

(57) ABSTRACT

Embodiments including misfiring print nozzle compensation are disclosed.

20 Claims, 4 Drawing Sheets

MISFIRING PRINT NOZZLE COMPENSATION

INTRODUCTION

Production or high volume of printed material has until now mostly been performed using analog printing systems. Examples of analog printing system technologies include offset lithographic, rotogravure, and flexography. Issues with analog technology include initial set up costs for a given print design. This creates an incentive toward printing large quantities of a given image design to reduce cost per print-something that makes the printing of customized documents and inventory management difficult.

More recently digital printers have begun to achieve performance levels that enable printing of some printing that historically was done using analog technology. Challenges with digital printers have been in achieving the cost per print, speed, and reliability expected from analog printers. The extra labor and other costs of operating and maintaining the digital presses to achieve consistent print quality has limited their market coverage to a small portion of the overall market.

DETAILED DESCRIPTION

Digital web presses can, in some situations, use a number of inkjet print nozzles carried by printheads mounted in an array to eject droplets of colorant (e.g., ink) onto a print medium. In some situations, the print medium can be a continuous sheet. A sheet-wide fixed array of print nozzles is positioned substantially perpendicular to progression of the print medium upon which droplets of colorant are ejected. In one embodiment, the print nozzles are arranged into one or more columnar groups with each columnar group aligned substantially perpendicular to the progression of the print medium. Together, the columnar groups span a width of the print medium, such that the columnar groups together are "sheet-wide". Within a columnar group the nozzles may have a "stagger" or a location offset relative to the direction of the progression of the print medium to compensate for operational timing of individual nozzles. When improper placement of colorant on the print medium, which can result in lessened quality of printed material, is detected during a print job performed by print nozzles, continuation of the print job can be delayed in order to analyze the cause of, and compensate for, the improper placement of colorant, possibly caused by misfiring of one or more print nozzles. Among other factors, ability to compensate for a misfiring print nozzle(s) can be limited by all print nozzles being constrained to fixed positions within a fixed array of printheads.

To facilitate continuity in printing with fewer corrections being made during a print job, a test pattern can be generated and analyzed beforehand to allow adjustments for misfiring of a print nozzle(s) to be made before starting the print job. Accordingly, among various embodiments of the present disclosure, a printing system can be used to generate a test pattern on a print medium using a number of print nozzles of an imaging device before initiating a print job, to examine the test pattern to determine whether one or more among the number of print nozzles is misfiring, to identify which of the number of print nozzles is capable of addressing one or more locations indicating misfiring of one or more print nozzles, and to compensate at least partially for the one or more misfiring print nozzles by repositioning of one or more of the columnar groups of nozzles one or more print nozzles capable of substituting for the identified one or more misfiring print nozzles at the one or more addressed locations on the print medium. In some embodiments, such a print job can be performed by a web press printing on a continuous sheet of print medium with one or more of the columnar groups of nozzles inkjet print nozzles, for example, when using a digital web press to print a newspaper.

Figure 1:
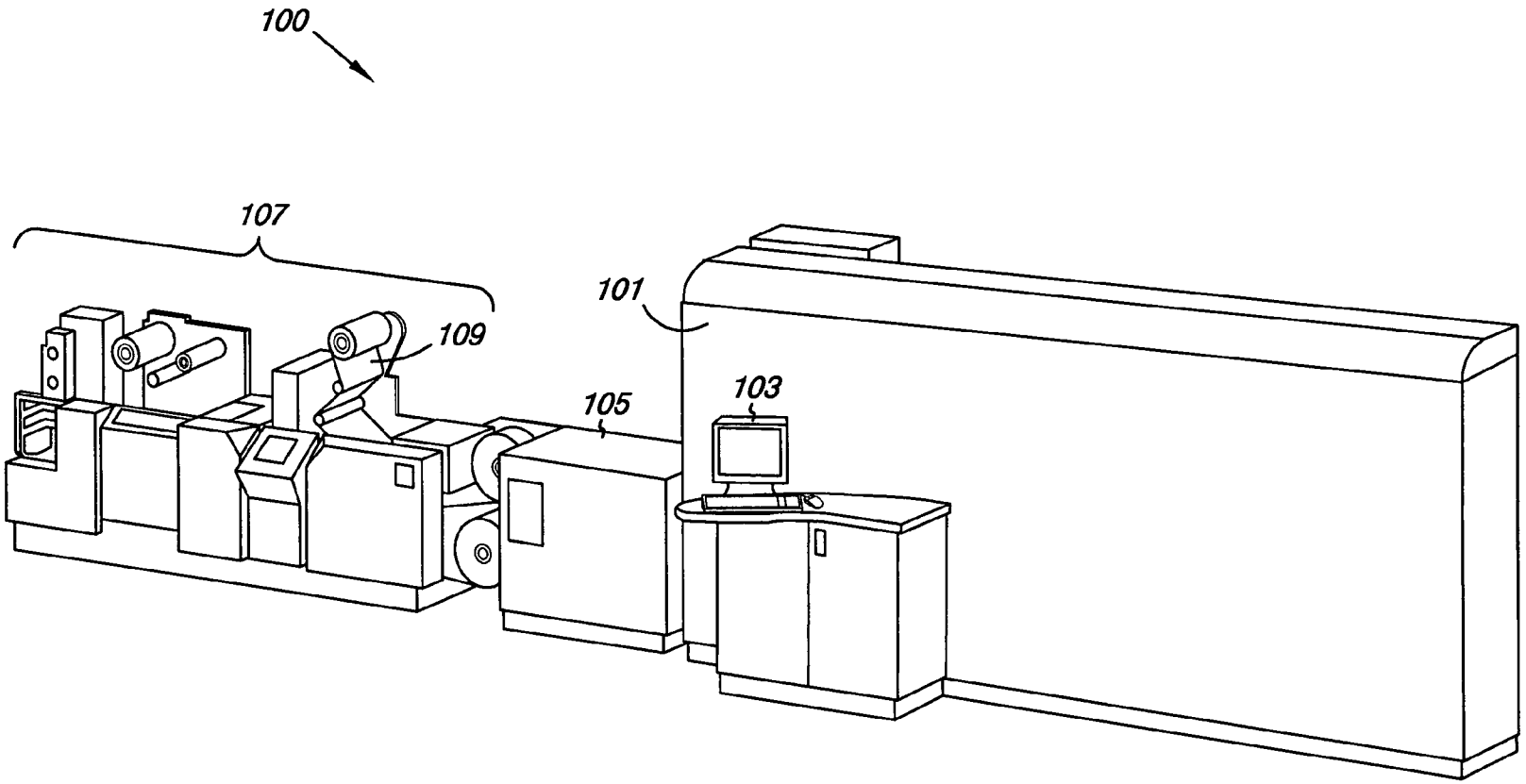
FIG. 1 illustrates a printing system according to an embodiment of the present disclosure.

FIG. 1 illustrates a printing system according to an embodiment of the present disclosure. The embodiment of FIG. 1 illustrates a printing system 100 that can include one or many of the embodiments described herein. The embodiment shown in FIG. 1 illustrates a printing portion 101 which can include embodiments such as, by way or example and not by way of limitation, an imaging device such as a web press printer for printing on a continuous sheet of print medium with one or more of the columnar groups of nozzles inkjet print nozzles. The printing portion 101 can be used for generating a test pattern on a print medium using a number of print nozzles of the imaging device before initiating a print job. In some embodiments, a test pattern can be printed on a print medium using a predetermined portion of the number of print nozzles, which, in some embodiments, can be substantially all of the print nozzles.

Examination of characteristics of a test pattern printed by print nozzles, which can be those intended to be used in a print job, can allow performance of the print nozzles to be evaluated before the print job is started. By way of example and not by way of limitation, a test pattern can be printed as one or more lines using every print nozzle capable of contributing colorant (e.g., ink) droplets to the line(s). In various embodiments, the printed line(s) can be examined to evaluate presence or absence of deposited droplets, along with accuracy of droplet placement, and color, density, and size, along with other characteristics, of the colorant droplet as deposited on the print medium.

The embodiment of FIG. 1 illustrates a user or operator interface 103, as appreciated by one of ordinary skill in the art. The user or operator interface 103 can enable interaction with a processor (not shown) capable of executing instructions for control of the printing system 100. The processor of the printing system 100 described in the present disclosure can contain encoded instructions to perform a variety of functions that, by way of example and not by way of limitation, can include instructions for algorithms, in various embodiments, that can allow the printing system 100 to be used for at least partially compensating for one or more misfiring print nozzles.

The embodiment shown in FIG. 1 illustrates a sensing device portion 105 that can include embodiments for examining a test pattern to determine whether one or more among a number of print nozzles is misfiring. In addition, at substantially the same time or otherwise, because the printing system 100 can be used to select print nozzles to address each location of an image printed on a print medium, the test pattern can be utilized for analysis to determine which of the number of print nozzles is capable of addressing each location to be printed on the print medium.

In a digital web press embodiment, each location on a sheet of print medium can be, in some embodiments, addressed by more than one print nozzle arranged in printheads transverse to progression of the sheet of print medium during a print job. That is, in some embodiments, for each location at which a droplet of colorant can be deposited on the print medium, more than one print nozzle can be selected to eject a droplet for deposit at that location.

In some embodiments, examining a test pattern can result in identifying which of the plurality of print nozzles is capable of addressing one or more locations indicating misfiring of one or more print nozzles. In various embodiments, by way of example and not by way of limitation, an indication of misfiring of a print nozzle(s) can be determined by examination of a test pattern using, for example, a vision system (e.g., a scanner) (not shown) that transmits a map of the examination to a processor (not shown), which, in some embodiments, can be accessible by the user or operator interface 103.

The processor can compare, in various embodiments, the map of the examined test pattern with a saved map of the print job as submitted to the printing system 100. The processor can also, in various embodiments, identify which among the number of print nozzles is capable of addressing one or more locations indicating misfiring of one or more print nozzles and selecting which among identified print nozzle(s) is suitable for substituting for the misfiring print nozzle(s). In some embodiments, selection of a suitable substitute print nozzle (s) can be premised upon implementation of an algorithm (for example, see FIG. 4).

The embodiment of the printing system 100 shown in FIG. 1 illustrates a processing section 107, which can include a source of print medium 109, and devices for turning of print medium 109 for printing on both sides thereof, drying, cutting, sorting, and packing of print medium 109, among other finishing components and equipment, that are not individually shown. The printing system 100 embodiment of FIG. 1 is operable on print media 109 which can include, in some embodiments, a continuous sheet, or web, of material that, in the embodiment of FIG. 1, can be stored on one or more rolls prior to and/or following printing thereon.

Operation of the various embodiments described herein can be performed according to one or more sets of computer executable instructions and/or under control of an application-specific integrated circuit to control and/or direct the operation of the printing system 100 and the manner in which the printing system 100 handles and/or operates on the print media 109. The relative ordering or placement or quantity of components, e.g., 101, 103, 105, 107, etc., is not limited to the example given in FIG. 1 and is considered flexible as suited to the particular design and/or use of the printing system. For example, some printing systems will have two printing portions 101 in sequence for printing on both sides of a print medium. Some will have multiple sensing device portions, including a first sensing portion 105 following (relative to print medium/web motion) a first printing portion 101 and a second sensing portion (not shown) following a second printing portion (not shown). Additionally, some printing systems 100 will have multiple processing sections 107 for pretreatment and drying of the print medium 109 located before and after each of the printing portions 101.

Figure 2:
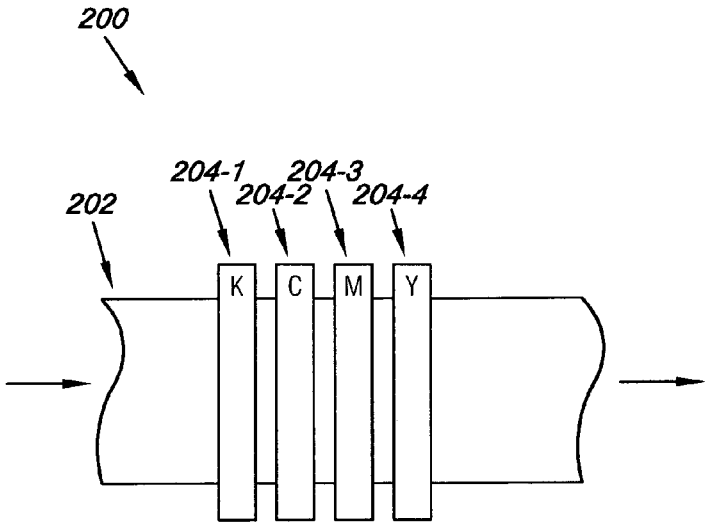
FIG. 2 illustrates a configuration of a printhead array according to an embodiment of the present disclosure.

FIG. 2 illustrates a configuration of a printhead array according to an embodiment of the present disclosure. The printhead array 200 in FIG. 2 is shown as an example of an array of printheads as typically positioned in a printing portion 101 of a printing system 100, as shown in the embodiment of FIG. 1, that uses more than one inkjet printhead. The printhead array 200 illustrated in FIG. 2 is shown by way of example and not by way of limitation; that is, printing systems can use varying numbers of printheads that utilize varying numbers and colors of colorants to be ejected from varying numbers of print nozzles.

The embodiment of the printhead array 200 illustrated in FIG. 2 is shown superimposed over a section of print medium 202. In embodiments where printheads utilize inkjet print nozzles, printing of text and/or an image on a print medium is accomplished, in various embodiments, by moving a printhead(s) that is narrower than the print medium transverse across an at least temporarily stationary print medium or using a printhead(s) that is substantially as wide as the print medium and having the print medium progress in a direction that is substantially perpendicular to the width of the printhead(s).

In FIG. 2, the embodiment of the section of print medium 202 can be a portion of a continuous sheet of print medium that progresses past a number of print nozzles (not shown) of the printhead array 200, in a direction shown by arrows at each end of the section of print medium 202, to allow text and/or images to be printed thereon. That is, a positioning of one or more printheads can be performed, in some embodiments, by arraying each substantially transverse relative to a progression of the print medium. In some embodiments, a web press printer can be used for printing on a continuous sheet of print medium with one or more of the columnar groups of nozzles inkjet print nozzles.

The embodiment of the printhead array illustrated in FIG. 2 depicts four (4) print "modules" or "bars", 204-1, 204-2, 204-3, and 204-4, that, by way of example and not by way of limitation, use four (4) different colorants, e.g., black (K), cyan (C), magenta (M), and yellow (Y) that can be ejected as droplets from a number of inkjet print nozzles. Each print module or bar, 204-1, 204-2, 204-3, and 204-4, may include one or more printheads (shown in FIG. 3) that in turn can include one or more columnar groups of nozzles. That is, multiple printheads can be employed for each print bar or module, 204-1, 204-2, 204-3, and 204-4. As shown in the embodiment of the printhead array 200, print module 204-1 (K) is positioned so that a location on a continuous sheet of print medium 202 progresses first past print module 204-1 (K). In some embodiments, a location on a print medium can first progress past a printhead using a black (K) colorant, as is shown in the embodiment of print module 204-1 (K) in FIG. 2. In the embodiment of the printhead array 200 shown in FIG. 2, the location on the continuous sheet of print medium 202 progresses past a second print module 204-2 (C) after it passes the first print module 204-1 (K). The print module 204-2 can, in some embodiments, use a cyan (C) colorant. Similarly, in the embodiment of printhead array 200, the continuous sheet of print medium 202 can progress past a third print module 204-3 (M) and then a fourth print module 204-4 (Y) after it passes the second print module 204-2 (C). In some embodiments, the third print module 204-3 can use a magenta (M) colorant and the fourth print module 204-4 (Y) can use a yellow (Y) colorant.

Figure 3:
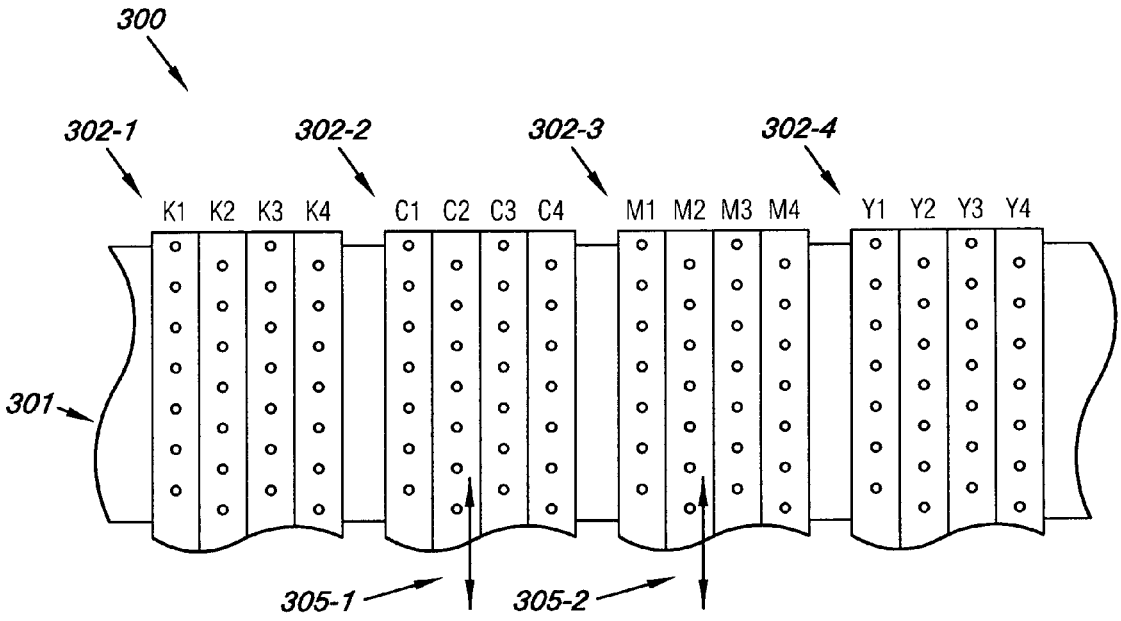
FIG. 3 illustrates a configuration of a printhead module array according to an embodiment of the present disclosure.

FIG. 3 illustrates a configuration of a printhead module array according to an embodiment of the present disclosure. The embodiment of the printhead module array 300 shown in FIG. 3 can be used to illustrate a more detailed representation of some embodiments consistent with the printhead array 200 shown in FIG. 2. The width of the printhead module array shown in FIG. 3 has been truncated at the bottom of FIG. 3 for illustrative purposes. As such, the scale of the printheads, modules, print nozzles, and print medium to each other do not necessarily represent a relative scale that would be implemented in an actual embodiment of the present disclosure.

The printhead module array 300 is shown superimposed over a section of print medium 301. In FIG. 3, the embodiment of the section of print medium 301 can be a portion of a continuous sheet of print medium that progresses past a number of print nozzles of one or more printheads carried by the printhead module array 300 to allow text and/or images to be printed thereon. That is, a positioning of one or more printhead modules can be performed, in some embodiments, by arraying each substantially transverse relative to a progression of the print medium. In some embodiments, a web press printer can be used for printing on a continuous sheet of print medium with one or more printhead modules each carrying one or more printheads containing a number of inkjet print nozzles.

The embodiment of the printhead array illustrated in FIG. 3 shows four (4) printhead modules that, by way of example and not by way of limitation, use four (4) different colorants that can be ejected as droplets from a number of inkjet nozzles. As shown in the embodiment of the printhead module array 300, by way of example and not by way of limitation, printhead module 302-1 carries four (4) columnar groups of nozzles arranged in parallel. In the embodiment of print head module array 300, the four (4) columnar groups of nozzles carried by printhead module 302-1 utilize black (K) colorant to be ejected as droplets from the number of print nozzles associated with each of the printheads, which are labeled K1, K2, K3, and K4 in the embodiment shown in FIG. 3.

In the embodiment of the printhead module array 300 shown in FIG. 3, the printhead module 302-1 can, in some embodiments, use a K colorant for the first printhead module past which the print medium 301 can progress. In some embodiments, cyan (C) colorant can be used for the second print head module 302-2, which, in some embodiments, can carry four (4) columnar groups of nozzles, which are labeled as columnar groups of nozzles C1, C2, C3, and C4 in printhead module array 300. Similarly, in the embodiment of printhead module array 300, the print medium 301 can progress past a third printhead module 302-3 carrying four (4) columnar groups of nozzles that use a magenta (M) colorant, which are labeled as columnar groups of nozzles M1, M2, M3, and M4, and then a fourth printhead module 302-4 carrying four (4) columnar groups of nozzles that use a yellow (Y) colorant, which are labeled as columnar groups of nozzles Y1, Y2, Y3, and Y4.

As illustrated in FIG. 3, in various embodiments, positioning of columnar groups of nozzles in an array can be performed by grouping columnar groups of nozzles using a same colorant together in one or more modules when more than one columnar groups of nozzles is utilized. As shown in each of the K1-4, C1-4, M1-4, and Y1-4 columnar groups of nozzles groupings of FIG. 3, positioning of the more than one printhead in the module can involve staggering the positions of the print nozzles of a first printhead, e.g., a printhead containing the columnar group of nozzles K1, relative to the print nozzles of a second printhead, e.g., a printhead containing the columnar group of nozzles K2, where the staggering is substantially arrayed transverse relative to the progression of the print medium.

In some embodiments of the present disclosure, as illustrated in FIG. 3, when a print nozzle in printhead K1, for example, is determined to be misfiring by examination of a test pattern, a print nozzle in columnar group K3 of printhead module 302-1 that, in some embodiments, aligns with the misfiring print nozzle in columnar group K1, can be used as a substitute to at least partially compensate for the otherwise inadequate performance of the misfiring print nozzle. Although embodiments disclosed herein describe use of a test pattern, embodiments are not limited to this example. One of ordinary skill in the art will recognize that misfiring can also be determined from performance of electrical checks to find nozzles out due to blown resistors. Additionally, misfiring can be determined using optical and/or electrostatic charge drop detection. Combinations of these techniques are also considered within the scope of the embodiments. In some embodiments, if an aligning print nozzle of columnar group K3 is unavailable, possibly due to it also misfiring, or for other reasons, an aligning one or more print nozzles of columnar group C1 or C3 of printhead module 302-2, columnar group M1 or M3 of printhead module 302-3, and/or columnar group Y1 or Y3 of printhead module 302-4 can be used to substitute for the otherwise inadequate performance of the misfiring print nozzle in columnar group K1 of printhead module 302-1, as further described below.

Similarly, for example, if a print nozzle in columnar group K2 is determined to be misfiring, a substitute print nozzle can be selected, in some embodiments by a processor, from aligned print nozzles in columnar groups K4, C2, C4, M2, M4, Y2, and/or Y4. Moreover, substitution of print nozzles can be done in the reverse direction of print media progression; that is, for example, a misfiring print nozzle in columnar group K3 can be substituted for with an aligned print nozzle in columnar group K1, and a misfiring print nozzle in columnar group K4 can be substituted for an aligned print nozzle in columnar group K2.

In some situations, however, examination of a test pattern can disclose that multiple print nozzles are misfiring in a vicinity of a linear path along a length of the print medium. In such a situation, a substantial number of, or possibly all, the print nozzles aligned with the misfiring print nozzle (e.g., a print nozzle of columnar group K1) of the various printhead modules (e.g., the aligned print nozzles of columnar groups K1, K3, C1, C3, M1, and/or M3) can be inadequate for substitution because they, too, can be determined to be misfiring print nozzles. As just described, the number of print nozzles as originally positioned, even when staggered as shown in the printheads carried by the print modules illustrated in the printhead module array 300 of FIG. 3, can cause difficulties in identifying which of the number of print nozzles is capable of addressing a location on the print medium indicated by examination of the print pattern as evidencing misfiring of a particular print nozzle. Hence, using the print nozzles as originally positioned in FIG. 3 can, in some embodiments, cause difficulties in compensating for a misfiring first print nozzle in a printhead carried by a first printhead module by substituting use of one or more second print nozzles from a printhead carried by one or more second printhead modules.

In some embodiments of the present disclosure, as illustrated in FIG. 3, one or more printhead modules can be repositioned to enable print nozzles being carried to correct, at least partially, for difficulty in identifying print nozzles capable of substituting for another misfiring print nozzle, as just described. An embodiment of repositioning printhead modules is illustrated in FIG. 3, which shows double-headed arrows 305-1 and 305-2 below printhead modules 302-2 and 302-3, respectively, indicating an ability to move the printhead modules in either direction substantially transverse to the direction of print medium progression. In some embodiments, repositioning can involve positioning printhead modules such that print nozzles of printheads carried by one or more repositioned printhead modules can substantially align with one or more misfiring print nozzles in another printhead module. In some embodiments, individual printheads (e.g., not positioned as groupings in a printhead module) can be repositioned to allow for micro-positioning that can at least partially compensate for misfiring print nozzles in multiple positions located along a width of one or more printheads.

As such, the printing system of the present disclosure can, in some embodiments, compensate at least partially for one or more misfiring print nozzles by repositioning of one or more of the columnar groups of nozzles one or more print nozzles capable of substituting for the identified one or more misfiring print nozzles at the one or more addressed locations on the print medium. In some embodiments, repositioning of the one or more print nozzles carried by the one or more printheads can be performed by repositioning of the one or more printheads substantially transverse relative to a progression of the print medium. Accordingly, in some embodiments, repositioning of the one or more printheads substantially transverse can result in enabling one or more print nozzles to substitute for the one or more misfiring print nozzles at the one or more addressed locations on the print medium. In some embodiments, the printing system can be a commercial web press printer for printing on a continuous sheet of print medium with one or more of the columnar groups of nozzles inkjet print nozzles.

The printhead modules 302-1, 302-2, 302-3, and 302-4 depicted in FIG. 3 include on printhead module for each ink colorant (one for each of K, C, M, and Y). In some embodiments, there may be multiple printhead modules for each of one or more ink colorants. For example, there may be two such printhead modules for black (K) ink with a second printhead module including columnar groups of nozzles K5, K6, K7, and K8 (not shown). The additional columnar groups may be utilized to enable faster print media web speeds and/or replacement of misfiring nozzles.

The printhead modules 302-1, 302-2, 302-3, and 302-4 depicted in FIG. 3 illustrate four ink colorants, e.g., K, C, M, and Y. However, embodiments are not limited to this example and more or fewer ink colorants can be included. For example, in some embodiments additional printhead modules providing additional colorants are possible, including orange (O), red (R), green (G), violet (V), light cyan (LC), light magenta (LM), or white (W), to name a few. Spot colors targeted to specific applications such as packaging are also possible. The methods of the present invention are applicable to the additional colorants.

In some embodiments of the printing system of the present disclosure, a processor can be used for executing instructions to at least partially compensate for one or more misfiring print nozzles. In various embodiments, a processor can execute instructions to register a repositioning of one or more printheads in a memory and initiate a print job using the repositioned one or more printheads to compensate at least partially for the one or more misfiring print nozzles. In some embodiments, a processor can execute instructions to at least partially determine which of a number of print nozzles are potential substitutes by determining which of the number of print nozzles are capable of being repositioned to substitute for the one or more misfiring print nozzles.

In various embodiments of the present disclosure, at least partially compensating for a first misfiring print nozzle(s) can be performed by substituting firing of one or more second print nozzles that use one or more colorants that are different from the colorant intended to be used by the misfiring first print nozzle(s). In various embodiments, compensating for a misfiring print nozzle(s) by substituting firing of a print nozzle(s) using a different colorant can be performed before, substantially at the same time as, after, or instead of, at least partially compensating for the misfiring print nozzle(s) by repositioning print nozzles of one of more printheads and/or printhead modules.

In some embodiments, at least partially compensating for misfiring print nozzles can be accomplished by combining repositioning of print nozzles with substituting firing of print nozzles that use one or more different colorants, along with, in some embodiments, combining these means of compensation individually and/or together with other means of at least partially compensating for misfiring print nozzles. In various embodiments, the various means of compensating for misfiring print nozzles can be performed using a web press printer for printing on a continuous sheet of print medium with one or more of the columnar groups of nozzles inkjet print nozzles.

In various embodiments, at least partially compensating for a potentially misfiring print nozzle can be performed by generating a test pattern on a print medium using a number of print nozzles of an imaging device before initiating a print job, and examining the test pattern to determine whether one or more among the number of print nozzles is misfiring. If a misfiring print nozzle(s) is found by examining the test pattern, identification can be made of which of the number of print nozzles is capable of addressing the one or more locations that indicate, in some embodiments by examination of the test pattern, misfiring of one or more print nozzles. Identification of which print nozzles are capable of addressing a defined location of a misfiring print nozzle can assist in determining which print nozzle(s) can be a candidate(s) for selection as a substitute print nozzle(s) to at least partially compensate of the misfiring print nozzle(s). In various embodiments, compensating at least partially for the one or more misfiring print nozzles can be performed by substituting firing of one or more print nozzles for the identified one or more misfiring print nozzles at the one or more addressed locations on the print medium.

In some embodiments of the present disclosure, substituting firing of one or more print nozzles can include substituting firing of one or more print nozzles using a colorant that is the same as the colorant used in the one or more misfiring print nozzles. For example, in some embodiments, an algorithm can determine that a first level of selection as a candidate print nozzle for use as a substitute is a print nozzle that uses the same colorant as the print nozzle for which the candidate print nozzle is substituting. In some embodiments, the print nozzle (s) that uses the same colorant, or a different colorant, can include those print nozzles capable of being repositioned to address the defined location of the misfiring print nozzle(s).

In various embodiments, substituting firing of one or more print nozzles can include substituting firing of one or more print nozzles using one or more colorants that are different from the colorant used in the one or more misfiring print nozzles. In some embodiments, substituting firing of print nozzles using colorants that are different from the colorant used in the misfiring print nozzles can be performed when it has been determined that one or more print nozzles firing the same colorant are not available. Substituting firing of one or more print nozzles using a colorant that is different can be performed, in various embodiments, by executing an algorithm to determine which of a number of colorants utilized in the print nozzles can be used to substitute for the colorant of the one or more misfiring print nozzles.

Figure 4:
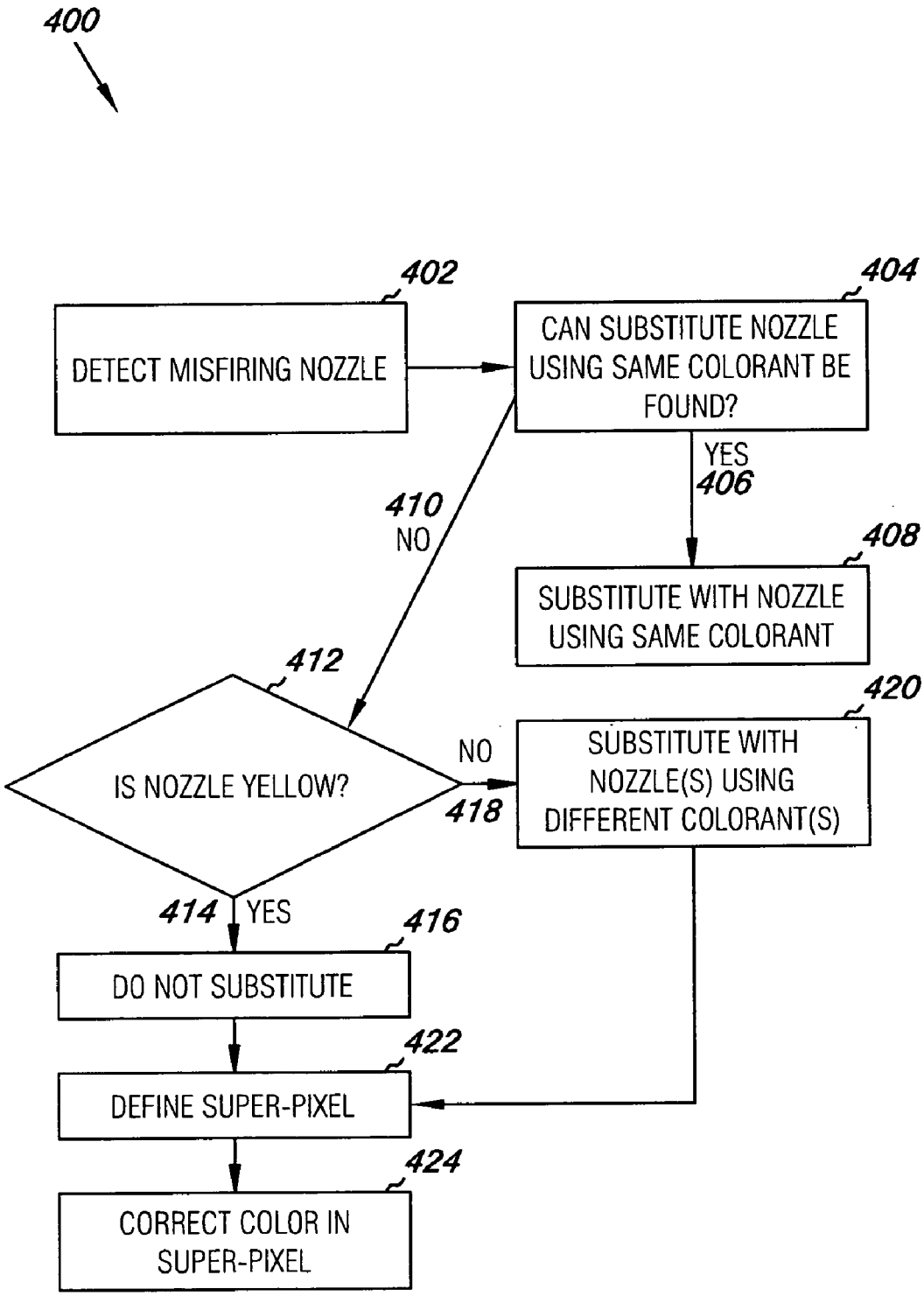
FIG. 4 is a block diagram illustrating a representation of an algorithm according to an embodiment of the present disclosure.

FIG. 4 is a block diagram illustrating a representation of an algorithm according to an embodiment of the present disclosure. As illustrated in FIG. 4, an embodiment of an algorithm 400 can be used to determine which of a number of colorants utilized in the print nozzles of a printing system can be used to substitute for a misfiring print nozzle(s) can begin, in some embodiments, with detecting a misfiring print nozzle(s) 402. A number of print nozzles of a printing system can use a number of different colorants for printing text and/or images on a print medium. In some embodiments, detection of misfiring print nozzles can be performed by examining a test pattern printed using a number of print nozzles that use a number of different colorants.

By way of example and not by way of limitation, in some embodiments of the present disclosure, the colorants used by the print nozzles can include K, C, M, and/or Y colorants. The following description of an algorithm used for determining substitution of a second colorant(s) for a first colorant will use K, C, M, and Y as candidates for selection as a substitute(s); however, embodiments of algorithms that are consistent with the present disclosure are not so limited.

In some embodiments, as shown in FIG. 4, after a misfiring print nozzle(s) has been detected 402, the algorithm 400 can be used to determine whether a print nozzle(s) using the same colorant as the misfiring print nozzle(s) can be found 404, and which can be used as a substitute. If such a substitute print nozzle(s) can be found 406, the algorithm 400 can be used to cause substitution for the misfiring print nozzle(s) to be executed 408 with a print nozzle(s) using the same colorant. In some embodiments, if a candidate print nozzle using the same colorant can not be found 410, the algorithm 400 can be used to begin determining whether a substitute print nozzle(s) using a different colorant(s) can be utilized. In various embodiments, the algorithm 400 can be used to select which candidate print nozzle(s) using a second colorant(s) is selected as a substitute for the misfiring print nozzle(s) using a first colorant.

In some embodiments, the algorithm 400 can be used to determine whether the misfiring print nozzle(s) use a Y colorant 412. If the misfiring print nozzle(s) are determined to use Y for the colorant 414, in some embodiments, the algorithm can be used to direct that no print nozzle is utilized for substituting a different colorant(s) 416. In situations where a misfiring print nozzle uses a Y colorant and misfiring thereof can result in one Y droplet (or a relatively low number of Y droplets) not being deposited in text and/or an image on the print medium, substitution with a second color(s) of colorant (s) can cause a more notable change in the appearance of the text and/or image than making no substitution. That is, substitution for Y with K, C, and/or M colored droplets can be more notable, and possibly less desirable, than not providing any colorant at the location of the intended Y droplet.

Not using a print nozzle to provide a substitute colorant can result in no colorant droplet(s) being applied to the intended location of the misfiring print nozzle using Y colorant, which can result in a color of the print medium appearing to be a substitute colorant. The color of the print medium can, in some embodiments, be less notable, and possibly more desirable, than substitution for Y colorant with K, C, and/or M colorants (e.g., when the print medium is substantially white).

In the embodiment shown in FIG. 4, when the misfiring print nozzle(s) is determined not to use Y colorant 418, the algorithm can be used to direct that a print nozzle(s) using a second colorant(s) substitute for the misfiring print nozzle(s) using the first colorant 420. In some embodiments, when the misfiring print nozzle(s) use K as the colorant, and no print nozzle(s) using K can be found as a substitute, the algorithm 400 can be used to direct that print nozzles using the C, M, and Y colorants can be utilized in combination to provide a composite black at locations where the misfiring print nozzle(s) were intended to deposit K colorant. In some embodiments, a print nozzle(s) using just C or M colorant can be selected by the algorithm 400 to substitute for a misfiring print nozzle(s) using K colorant.

In some embodiments, a decision by the algorithm 400 to use a print nozzle using C or M colorant as a substitute for K colorant can depend on unavailability of sufficient print nozzles that use C, M, and Y colorants to address a defined location(s) at which a misfiring print nozzle(s) would deposit K colorant. In such a situation, where a misfiring print nozzle uses a K colorant and misfiring thereof can result in one K droplet (or a relatively low number of K droplets) not being deposited in text and/or an image on the print medium, substitution with a second color of colorant, such as C or M, can cause a less notable change in the appearance of the text and/or image than making no substitution. That is, substitution for K with a C or M colored droplet(s) can be less notable, and possibly more desirable, than not providing any colorant at the location of the intended K droplet(s) (e.g., when the print medium is substantially white). In some embodiments, a print nozzle using C colorant can be combined with a print nozzle using M colorant to eject droplets to substitute for a misfiring print nozzle using K colorant.

In various embodiments, the algorithm 400 can be used to direct that a misfiring print nozzle(s) using C or M colorant be substituted for with a print nozzle(s) using K colorant. In some embodiments, a decision by the algorithm 400 to use a print nozzle using K colorant as a substitute for C or M colorants can depend on unavailability of sufficient print nozzles that use C or M colorant to address a defined location (s) at which a misfiring print nozzle(s) would deposit C or M colorant.

In such a situation, where a misfiring print nozzle uses a C or M colorant and misfiring thereof can result in one C or M droplet (or a relatively low number of C or M droplets) not being deposited in text and/or an image on the print medium, substitution with a second dark color of colorant, such as K, can cause a less notable change in the appearance of the text and/or image than making no substitution. That is, substitution for C or M with K colored droplets can be less notable, and possibly more desirable, than not providing any colorant at the location of the intended C or M droplet(s) (e.g., when the print medium is substantially white). In some embodiments, a print nozzle using C colorant can be used to substitute for a misfiring print nozzle using M colorant, and vice versa.

In the embodiment illustrated in FIG. 4, the algorithm 400 can be used to direct, as described above, that no substitution be made for a misfiring print nozzle using Y colorant 416, or the algorithm 400 can be used to direct that a misfiring print nozzle(s) using another colorant(s) (e.g., K, C, and/or M colorants) as a first colorant be substituted for with a print nozzle(s) using a second colorant(s) (e.g., K, C, and/or M) 420.

In various embodiments, a super-pixel(s) can be defined 422 by defining a region(s) in which a general correction of color, or hue, can potentially correct for a difference(s) caused by not substituting, or substituting a different color, for a misfiring print nozzle(s). In some embodiments, the algorithm 400 can be used to determine that adjustment of ejection of droplets of colorant to locations in the super-pixel by a selected print nozzle(s) using an appropriate colorant(s) can at least partially correct for color, or hue, change in the super-pixel. Accordingly, in some embodiments, the color, or hue, of the super-pixel can be at least partially corrected by adjusting ejection of colorant droplets by the selected print nozzle (s) 424.

By way of example and not by way of limitation, if a number of neighboring locations on the print medium have no substitution for a misfiring print nozzle using Y colorant, or substitution for a first colorant with a second colorant, the effect may become notable to a user of the printing system and/or a third party. However, substitution with Y colorant, or the first colorant, at locations in the vicinity of the location where the misfiring print nozzle would have deposited the Y colorant, or the first colorant, can at least partially correct the color, or hue, in the visible region, or super-pixel, as perceived by a user and/or a third party.

As such, in various embodiments, an algorithm can be used for firing of one or more print nozzles to accomplish adjusting color in a region in which one or more print nozzles are used for substituting one or more colorants that are different from the colorant used in the one or more misfiring print nozzles. In some embodiments of the present disclosure, at least partial correction of color, or hue, in a super-pixel can be combined with compensating at least partially for one or more misfiring print nozzles by repositioning of one or more printheads carrying one or more print nozzles capable of substituting for the identified one or more misfiring print nozzles at the one or more addressed locations on the print medium.

In some embodiments wherein the printing system, e.g., 100 shown in FIG. 1, utilizes white ink (W), 412 of algorithm 400 may apply the white ink (W) and/or the yellow ink (Y). That is, if a missing nozzle ejects white ink, then there will be no substitution. In some embodiments, it may make sense to substitute W for Y and/or Y for W particularly for printing upon a dark background.

In some embodiments, variations of the algorithm 400 shown in FIG. 4 can be implemented using a processor to execute instructions to at least partially determine which of a number of print nozzles is a potential substitute by determining which of a number of colorants utilized in the print nozzles can be used to substitute for the one or more misfiring print nozzles. In some embodiments, the processor can be utilized in a printing system that includes a web press printer for printing on a continuous sheet of print medium with one or more of the columnar groups of nozzles inkjet print nozzles.

In various embodiments of the present disclosure, a printing system can at least partially compensate for one or more potentially misfiring print nozzles that are intended to eject a specified first color of colorant (e.g., ink) to defined locations on the print medium by using one or more print nozzles to deposit droplets of a specified second colorant(s) at the defined locations that are intended to receive the first colorant. That is, in some embodiments, at least partially compensating for a potentially misfiring print nozzle can be performed in substantially all locations where a first colorant is intended to be deposited by using at least one other print nozzle to deposit a second colorant where the first colorant is intended to be deposited.

In some embodiments, depositing the second colorant(s) where the first colorant is intended to be deposited can be performed substantially at the same point in time that the first colorant is intended to be deposited on the print medium. That is, in some embodiments, a determination of whether any print nozzles using the first colorant are misfiring, and, if so, identification of the misfiring print nozzles, can be delayed and/or eliminated because, in substantially all locations where the first colorant is to be deposited, at least partial compensation for a potentially misfiring print nozzle using the first colorant can be performed proactively by depositing a second colorant(s) at substantially all of those locations.

By way of example and not by way of limitation, in some embodiments, an algorithm can be used to direct a print nozzle(s) using C colorant to deposit droplets on a print medium at substantially every location where a print nozzle (s) using K colorant is intended to deposit droplets. In some embodiments, a first colorant (e.g., K) can substantially mask a second colorant(s) (e.g., C, M, and/or Y) when the first colorant and the second colorant(s) are deposited at substantially the same location, thereby making a presence of the second colorant(s) less apparent to a user and/or a third party. When a print nozzle(s) using the first colorant (e.g., K) misfires, however, a droplet(s) deposited at substantially the same location by a print nozzle(s) using a second colorant(s) (e.g., C, M, and/or Y) can become more apparent to a user and/or a third party and can at least partially compensate for the misfiring print nozzle(s) using the first colorant.

Depositing a second colorant(s) in substantially every location where a first colorant is intended to be deposited in order to at least partially compensate for a potentially misfiring print nozzle(s) using the first colorant can be termed "underprinting". Some examples of combinations of colorants that can be used in underprinting, in various embodiments, are described above with regard to substitution of one colorant for another colorant.

In various embodiments, a printing system using underprinting for at least partially compensating for misfiring of a print nozzle(s) can generate a test pattern on a print medium using a number of print nozzles of an imaging device before initiating a print job, and identify which of the number of print nozzles can be used to address substantially each defined location on the print medium. The printing system can be used to analyze a print job prior to printing to identify which among the number of print nozzles will supply a first colorant to one or more defined locations in forming an image on the print medium, and the printing system can be used to select one or more print nozzles capable of supplying at least a second colorant to the one or more defined locations on the print medium to which the first colorant is intended to be supplied. In some embodiments, the printing system can use a web press printer for printing on a continuous sheet of print medium with one or more of the columnar groups of nozzles inkjet print nozzles.

In some embodiments, an imaging device of the printing system can be used for printing of an image on a print medium by underprinting with at least a second colorant using one or more selected print nozzles at each of the one or more defined locations to which the first colorant is intended to be supplied. In some embodiments, underprinting with at least the second colorant can result in at least partially compensating for misfiring of one or more print nozzles intended to supply the first colorant at each of the one or more defined locations. In some embodiments, underprinting by firing of one or more print nozzles using a second colorant(s) that is different from the first colorant can be performed by executing an algorithm to determine which of a number of colorants utilized in the print nozzles can be used to underprint for the one or more potentially misfiring print nozzles using the first colorant.

Figure 5:
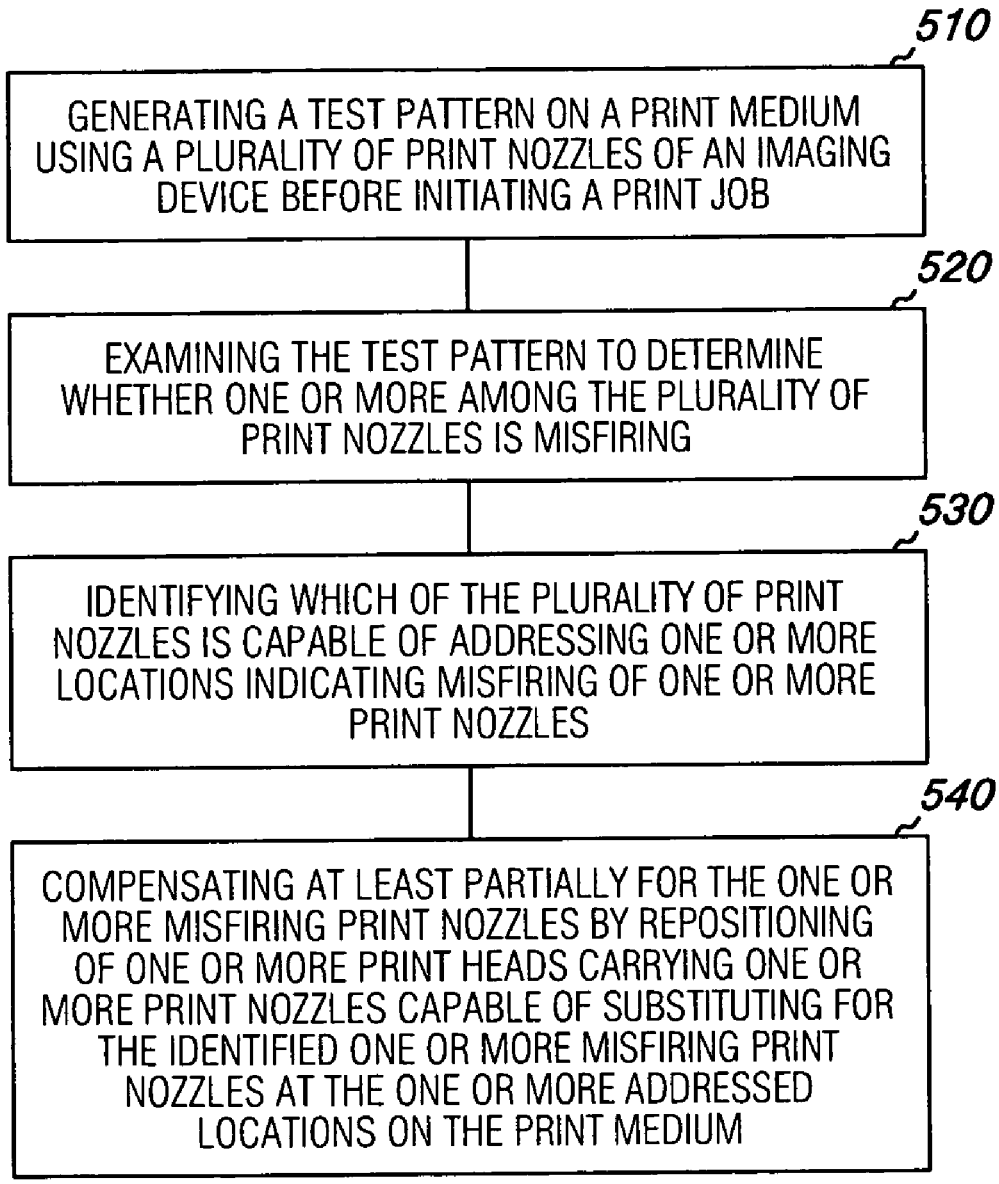
FIG. 5 is a block diagram illustrating a method of at least partially compensating for misfiring of a print nozzle according to an embodiment of the present disclosure.

FIG. 5 is a block diagram illustrating a method of at least partially compensating for misfiring of a print nozzle according to an embodiment of the present disclosure. Unless explicitly stated, the method embodiments described herein are not constrained to a particular order or sequence. Additionally, some of the described method embodiments, or elements thereof, can occur or be performed at the same, or at least substantially the same, point in time.

The embodiments described herein can be performed using logic, software, hardware, application modules, or combinations of these elements, and the like, to perform the operations described herein. Embodiments as described herein are not limited to any particular operating environment or to software written in a particular programming language. In various embodiments, the elements just described can be resident on the systems, and/or devices shown herein, or otherwise. Logic suitable for performing embodiments of the present disclosure can be resident in one or more devices and/or locations. Processing modules used to execute operations described herein can include one or more individual modules that perform a number of functions, separate modules connected together, and/or independent modules.

The embodiment illustrated in FIG. 5 includes generating a test pattern on a print medium using a number of print nozzles of an imaging device before initiating a print job, as shown in block 510 and as described above. Block 520 of the embodiment shown in FIG. 5 includes examining the test pattern to determine whether one or more among the number of print nozzles is misfiring, as described above. Block 530 of the embodiment includes identifying which of the number of print nozzles is capable of addressing one or more locations indicating misfiring of one or more print nozzles, as described above.

Block 540 of the embodiment shown in FIG. 5 includes compensating at least partially for the one or more misfiring print nozzles by repositioning of one or more of the columnar groups of nozzles one or more print nozzles capable of substituting for the identified one or more misfiring print nozzles at the one or more addressed locations on the print medium, as described above. In some embodiments, the at least partial compensation for misfiring print nozzles by repositioning other print nozzles is maintained for use at various time points during a print job, which, in various embodiments, can be performed at any time thereafter. In some embodiments, the repositioned print nozzles can be used in the repositioned configuration until completion of a print job. Moreover, any of the means for at least partially compensating for misfiring of print nozzles described in the present disclosure can be maintained for use by a printing system, and/or saved in memory for execution by a processor and/or any other means of implementing an algorithm to perform execution of a method stored on a machine-readable medium, in performing a print job at scheduled time points, or time points yet to be determined.

In various embodiments of printing systems to which the present disclosure can apply, such as a commercial digital web press printer for printing on a continuous sheet of print medium with of the columnar groups of nozzles inkjet print nozzles, print jobs lasting several hours can be intended. When performing a print job of such length, particularly in a commercial setting, a user can desire that interruptions are reduced to address compensating for misfiring print nozzles affecting print quality. Analyzing printed test patterns to identify misfiring print nozzles and at least partially compensating for the misfiring print nozzles by repositioning other print nozzles and/or determining substitution of firing droplets by already positioned print nozzles prior to beginning a print job can assist in reducing frequency and/or length of such interruptions. Additionally, using a print nozzle(s) for underprinting with a second colorant(s) to at least partially compensate for potential misfiring of a print nozzle(s) using a first colorant can be used in place of, or in combination with, the just-described means of compensation to assist in reducing frequency and/or length of such interruptions.

In some embodiments of the present disclosure, operations similar to blocks 510 to 540 of FIG. 5 can be performed continuously during printing rather than before initiating a print job.

Although specific embodiments have been illustrated and described herein, those of ordinary skill in the art will appreciate that an arrangement calculated to achieve the same techniques can be substituted for the specific embodiments shown. This disclosure is intended to cover all adaptations or variations of various embodiments of the present disclosure. It is to be understood that the above description has been made in an illustrative fashion, and not a restrictive one. Combination of the above embodiments, and other embodiments not specifically described herein will be apparent to those of skill in the art upon reviewing the above description. The scope of the various embodiments of the present disclosure includes other applications in which the above structures and methods are used. Therefore, the scope of various embodiments of the present disclosure should be determined with reference to the appended claims, along with the full range of equivalents to which such claims are entitled.

In the foregoing Detailed Description, various features are grouped together in a single embodiment for the purpose of streamlining the disclosure. This method of disclosure is not to be interpreted as reflecting an intention that the disclosed embodiments of the present disclosure have to use more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A method for misfiring print nozzle compensation, comprising:

generating a test pattern on a print medium using a number of print nozzles arranged into a plurality of columnar groups of nozzles in a printhead module of an imaging device before initiating a print job;

examining the test pattern to determine whether one or more among the number of print nozzles is misfiring;

identifying which of the number of print nozzles is capable of addressing one or more locations indicating misfiring of one or more print nozzles; and compensating at least partially for the one or more misfiring print nozzles by repositioning of one or more of the columnar groups of nozzles including one or more print nozzles capable of substituting for the identified one or more misfiring print nozzles in another of the columnar groups of nozzles at the one or more addressed locations on the print medium.

2. The method of claim 1, further comprising using a web press printer for printing on a continuous sheet of print medium with one or more of the columnar groups of nozzles each including inkjet print nozzles.

3. The method of claim 2, wherein a positioning of the one or more of the columnar groups of nozzles is performed by arraying each of the columnar groups of nozzles substantially transverse relative to a progression of the print medium.

4. The method of claim 3, wherein the positioning of the columnar groups of nozzles is performed by grouping columnar groups of nozzles using a same colorant together in one or more modules when more than one columnar groups of nozzles is utilized.

5. The method of claim 4, wherein the positioning of the more than one columnar groups of nozzles in the module involves staggering the positions of the print nozzles of a first columnar groups of nozzles relative to the print nozzles of a second columnar groups of nozzles, wherein the staggering is substantially arrayed transverse relative to the progression of the print medium.

6. The method of claim 1, wherein repositioning of the one or more print nozzles carried by the one or more columnar groups of nozzles is performed by repositioning of the one or more columnar groups of nozzles substantially transverse relative to a progression of the print medium.

7. The method of claim 6, wherein repositioning of the one or more columnar groups of nozzles substantially transverse results in enabling one or more print nozzles to substitute for the one or more misfiring print nozzles at the one or more addressed locations on the print medium.

8. A method of compensating for misfiring of a print nozzle, comprising:

generating a test pattern on a print medium using a number of print nozzles arranged as a plurality of columns in a printhead module of an imaging device before initiating a print job;

identifying which of the number of print nozzles can address defined locations on the print medium;

analyzing a print job prior to printing to identify which among the number of print nozzles will supply a first colorant to one or more defined locations in forming an image on the print medium; and selecting one or more print nozzles in another of the plurality of columns of nozzles capable of supplying at least a second colorant to the one or more defined locations on the print medium to which the first colorant is intended to be supplied.

9. The method of claim 8, further comprising using a web press printer for printing on a continuous sheet of print medium with one or more of the columnar groups of nozzles inkjet print nozzles.

10. The method of claim 8, further comprising printing of the image on the print medium by underprinting with at least the second colorant using the one or more selected print nozzles at each of the one or more defined locations to which the first colorant is intended to be supplied.

11. The method of claim 10, wherein underprinting with at least the second colorant results in at least partially compensating for misfiring of one or more print nozzles intended to supply the first colorant at each of the one or more defined locations.

12. A printing system, comprising:

a commercial web press printer for printing on a continuous sheet of print medium with a plurality of columnar groups of inkjet print nozzles; and computer executable instructions stored in a memory and executable by a processor to at least partially compensate for one or more misfiring print nozzles, wherein the computer executable instructions are executed to:

generate a test pattern on the print medium using a number of print nozzles of an imaging device before initiating a print job;

examine the test pattern to determine whether one or more among the number of print nozzles is misfiring;

identify which of the number of print nozzles is capable of addressing one or more locations indicating misfiring of one or more print nozzles; and compensate at least partially for the one or more misfiring print nozzles by substituting firing of one or more print nozzles on another of the columnar groups of inkjet print nozzles for the identified one or more misfiring print nozzles at the one or more addressed locations to print on the print medium using the web press printer.

13. The system of claim 12, wherein the computer executable instructions are executed to substitute firing of one or more print nozzles using a colorant that is the same as the colorant used in the one or more misfiring print nozzles.

14. The system of claim 13, wherein the computer executable instructions are executed to substitute firing of one or more print nozzles using one or more colorants that are different from the colorant used in the one or more misfiring print nozzles when one or more print nozzles firing the same colorant is not available.

15. The system of claim 14, wherein the computer executable instructions are executed to determine which of a number of colorants utilized in the print nozzles can be used to substitute for the one or more misfiring print nozzles when substituting firing of one or more print nozzles using a colorant that is different.

16. The system of claim 15, wherein the computer executable instructions are executed to substitute firing of one or more print nozzles having a white ink colorant when the one or more misfiring print nozzles have a yellow colorant and when one or more print nozzles firing the same colorant is not available.

17. The system of claim 15, wherein the computer executable instructions are executed to substitute firing of one or more print nozzles having a cyan ink colorant when the one or more misfiring print nozzles have a black colorant and when one or more print nozzles firing the same colorant is not available.

18. The system of claim 15, wherein the computer executable instructions are executed to substitute firing of one or more print nozzles having a black ink colorant when the one or more misfiring print nozzles have a magenta colorant and when one or more print nozzles firing the same colorant is not available.

19. The system of claim 18, wherein the computer executable instructions are executed to adjust color in a region in which one or more print nozzles are used for substituting one or more colorants that are different from the colorant used in the one or more misfiring print nozzles.

20. The system of claim 19, wherein the computer executable instructions are executed to register a repositioning of the one or more print nozzles and to initiate a print job using the repositioned one or more print nozzles to compensate at least partially for the one or more misfiring print nozzles.

* * * * *